US011264745B2

(12) United States Patent
Hwang

(10) Patent No.: US 11,264,745 B2
(45) Date of Patent: Mar. 1, 2022

(54) ELECTRICAL CONNECTOR AND METHOD OF MAKING THE SAME

(71) Applicants: FUDING PRECISION COMPONENTS (SHENZHEN) CO., LTD., Shenzhen (CN); FOXCONN INTERCONNECT TECHNOLOGY LIMITED, Grand Cayman (KY)

(72) Inventor: Tzu-Yao Hwang, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/907,614

(22) Filed: Jun. 22, 2020

(65) Prior Publication Data

US 2020/0403337 A1 Dec. 24, 2020

(30) Foreign Application Priority Data

Jun. 20, 2019 (CN) ..... 201910535043.2

(51) Int. Cl.
*H01R 12/71* (2011.01)
*H01R 13/24* (2006.01)
*H01R 12/57* (2011.01)

(52) U.S. Cl.
CPC ..... *H01R 12/716* (2013.01); *H01R 12/57* (2013.01); *H01R 13/24* (2013.01)

(58) Field of Classification Search
CPC .... H01R 43/055; H01R 12/716; H01R 12/57; H01R 13/24
USPC ..... 439/885
See application file for complete search history.

(56) References Cited

U.S. PATENT DOCUMENTS 4,037,915 A * 7/1977 Cabaud ..... H01R 12/728 439/858
4,593,463 A * 6/1986 Kamono ..... H05K 7/1069 29/884
6,652,329 B1 * 11/2003 Howell ..... H01R 12/52 439/862

(Continued)

FOREIGN PATENT DOCUMENTS

CN 201285852 Y 8/2009

*Primary Examiner* — Gary F Paumen
(74) *Attorney, Agent, or Firm* — Ming Chieh Chang; Wei Te Chung

(57) ABSTRACT

An electrical connector includes an insulative housing with a plurality of passageways extending through opposite upper and lower surfaces thereof, and a plurality of contacts retained in the corresponding passageways, respectively. The contact includes a main body, a spring arm extending from an upper end of the main body with a contacting section at a free end region thereof, and a tab extending upwardly from the main body for assembling the contact into the corresponding passageway. An auxiliary part extends from a side edge of the main body at an angle with a solder pad at the bottom end for securing a solder ball thereto. The tab is dimensioned to allow a fixture to grasp thereon for applying a downward force thereto during downwardly inserting the contact into the passageway, and is optionally adapted to be removed when the contact is moved to almost the final position.

12 Claims, 9 Drawing Sheets

(56) References Cited

U.S. PATENT DOCUMENTS

| | | | | |
|---|---|---|---|---|
| 7,074,048 | B2 * | 7/2006 | Liao | H01R 12/52 439/66 |
| 7,300,320 | B2 * | 11/2007 | Lee | H01R 12/728 439/862 |
| 7,628,661 | B2 * | 12/2009 | Liao | H01R 12/57 439/862 |
| 10,116,079 | B1 * | 10/2018 | Ju | H01R 12/7076 |
| 10,777,929 | B2 * | 9/2020 | Hwang | H01R 13/41 |
| 10,886,655 | B2 * | 1/2021 | Hwang | H01R 13/2442 |
| 2010/0248557 | A1 * | 9/2010 | Fan | H01R 43/16 439/816 |
| 2012/0100758 | A1 * | 4/2012 | Liaw | H01R 43/16 439/660 |
| 2019/0280415 | A1 * | 9/2019 | Huang | H01R 13/2464 |
| 2020/0052429 | A1 * | 2/2020 | Hwang | H01R 12/716 |
| 2020/0106203 | A1 * | 4/2020 | Hwang | H01R 13/2442 |
| 2020/0227840 | A1 * | 7/2020 | Ho | H01R 43/20 |
| 2020/0227855 | A1 * | 7/2020 | Ho | H01R 43/205 |
| 2021/0075178 | A1 * | 3/2021 | Hwang | H01R 13/2442 |

* cited by examiner

ELECTRICAL CONNECTOR AND METHOD OF MAKING THE SAME

BACKGROUND OF THE INVENTION

1. Field of the Invention

The present invention relates generally to an electrical an electrical connector which receives a CPU (Central Processing Unit), and particularly to the electrical connector with the contacts assembled therein with assistance of the upper retainer and the lower retainer.

2. Description of Related Arts

U.S. Patent Application Publication No. 2012/0100758 discloses an electrical connector for use with the CPU wherein each contact includes a main body with retaining mechanism thereon and a solder ball attached thereunder for mounting to the printed circuit board, and a spring contacting arm side by side linked with the main body for connecting to the CPU. In other words, each contact essentially has dual parts side by side linked with each other at an angle. Understandably, each contact originally is linked to a contact carrier strip via a top end of the main body so as to have all the contacts in the same row assembled into the corresponding passageways via that common contact carrier strip, i.e., applying the downward force upon the common contact carrier strip. Anyhow, because each contact takes the transverse space along the common contact carrier strip according to its own transverse/width dimension when the contact is in an expanded/extended manner, it inevitably limits the fine pitch arrangement of the contacts. Some approach tries to have the spring contact arm directly extend from the retaining main body without using the sideward part for reducing the width of the contact for allowing the fine pitch of the contacts in the housing and on the contact carrier strip. Anyhow, such a single part contact may result in inferior effect from the electrical viewpoint and unstable retention and assembling from the mechanical viewpoint, compared with the dual-part structure.

It is desired to provided the contact with the dual-part structure and in a fine pitch arrangement in the corresponding electrical connector wherein the contacts in a same row can be assembled into the corresponding passageways via the holding tool simultaneously.

SUMMARY OF THE INVENTION

To achieve the above object, an electrical connector for mounting a printed circuit board and receiving a CPU for electrical connection therebetween, includes an insulative housing with a plurality of passageways extending through opposite upper and lower surfaces thereof, and a plurality of contacts retained in the corresponding passageways, respectively. The contact includes a main body, a spring arm extending from an upper end of the main body, a contacting section at a free end region of the spring arm for connecting to the CPU, and a tab extending upwardly from the main body for assembling the contact into the corresponding passageway. An auxiliary part extends from a side edge of the main body at an angle with a solder pad at the bottom end for securing a solder ball thereto. The tab is dimensioned to be large enough to allow a fixture to grasp thereon for applying a downward force thereto during downwardly inserting the contact into the passageway, and is optionally adapted to be removed after the contact is moved to almost the final position.

Other advantages and novel features of the invention will become more apparent from the following detailed description of the present embodiment when taken in conjunction with the accompanying drawings.

BRIEF DESCRIPTION OF THE DRAWING

FIG. 1 is a perspective view of the electrical contact assembly of FIG. 5 separated from the corresponding housing of the connector;

DETAILED DESCRIPTION OF THE PREFERRED EMBODIMENT

Figure 1:
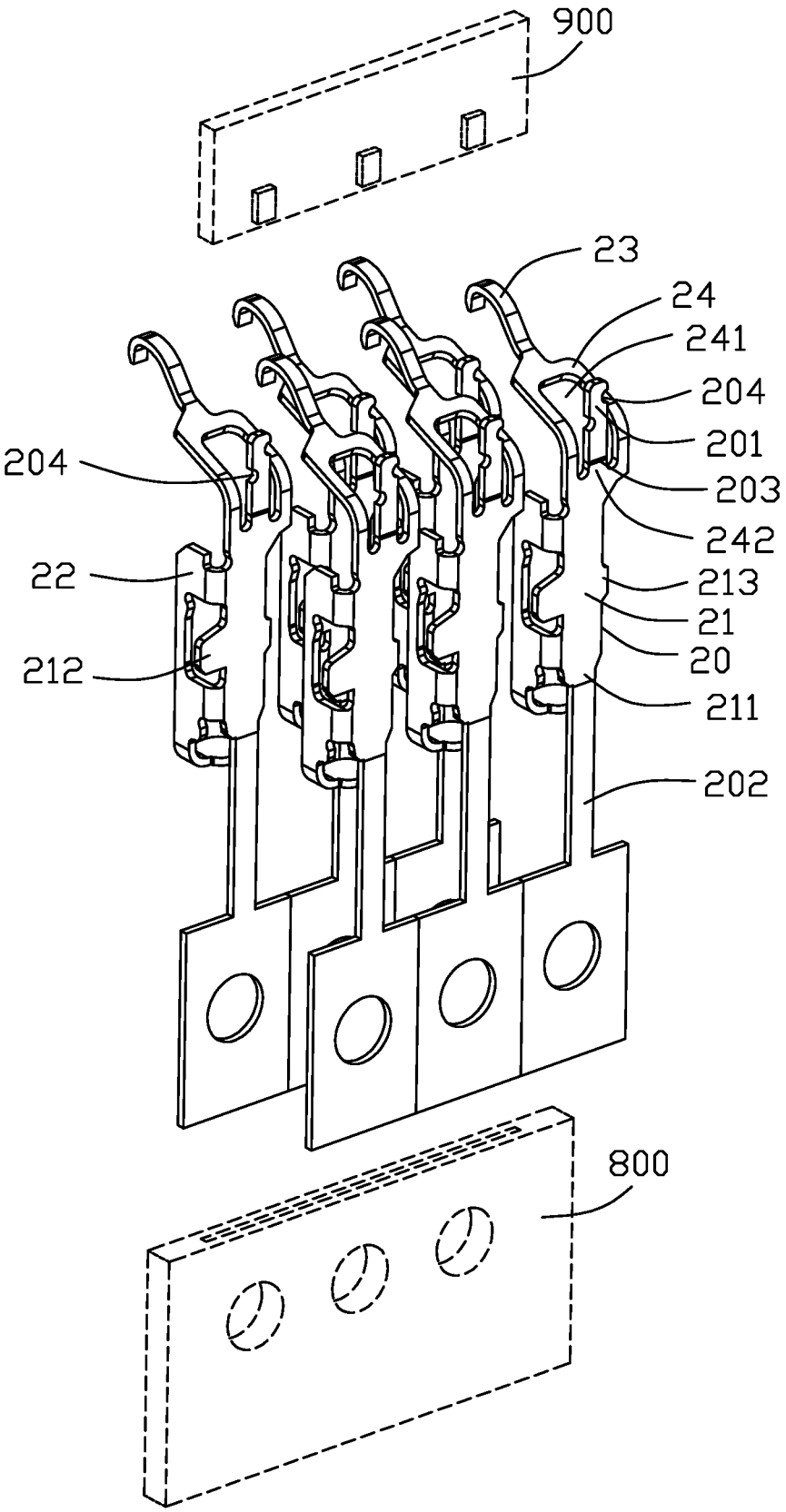
FIG. 1 is a perspective view of the electrical contact assembly including a plurality of contacts densely arrange with one another according to the invention wherein each contact is unitarily equipped with a holding base at the bottom portion and a holding tab around the upper portion.
Figure 2:
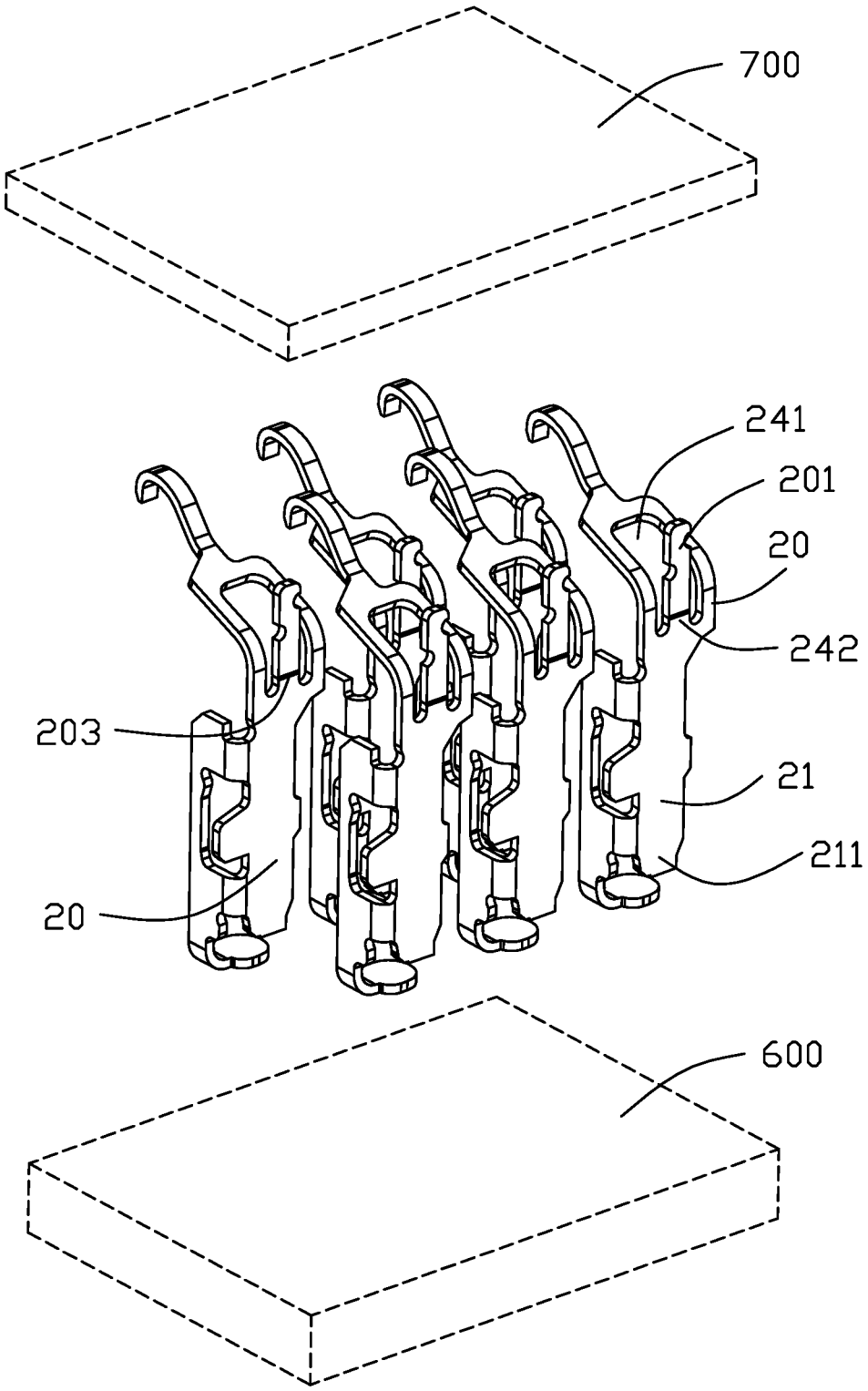
FIG. 2 is a perspective view of the electrical contact assembly of FIG. 1.
Figure 3:
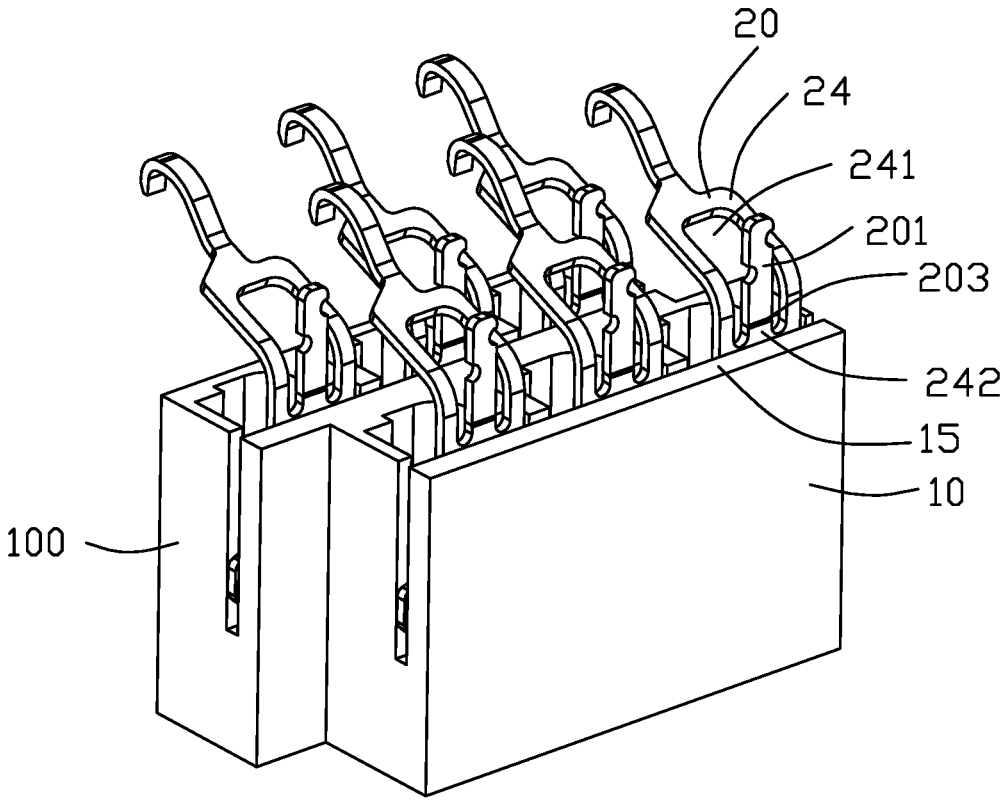
FIG. 3 is a perspective view of the electrical contact assembly of FIG. 2 assembled within the corresponding connector wherein the contacts are located at the intermediating position for being ready to remove the corresponding holding tab.
Figure 4:
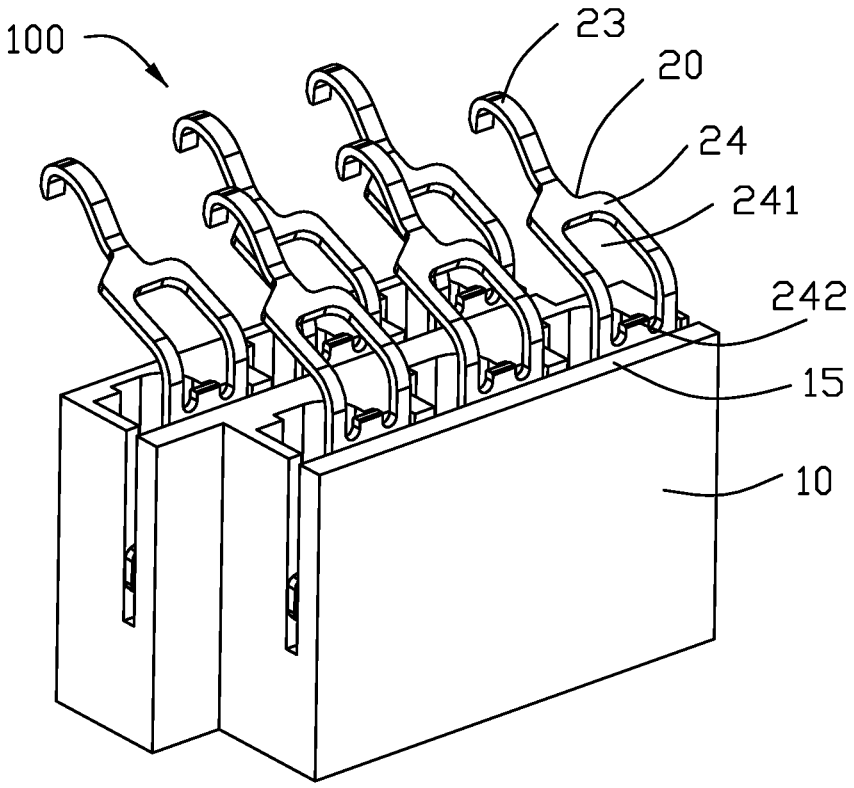
FIG. 4 is a perspective view of the electrical contact assembly of FIG. 3 in the connector.
Figure 5:
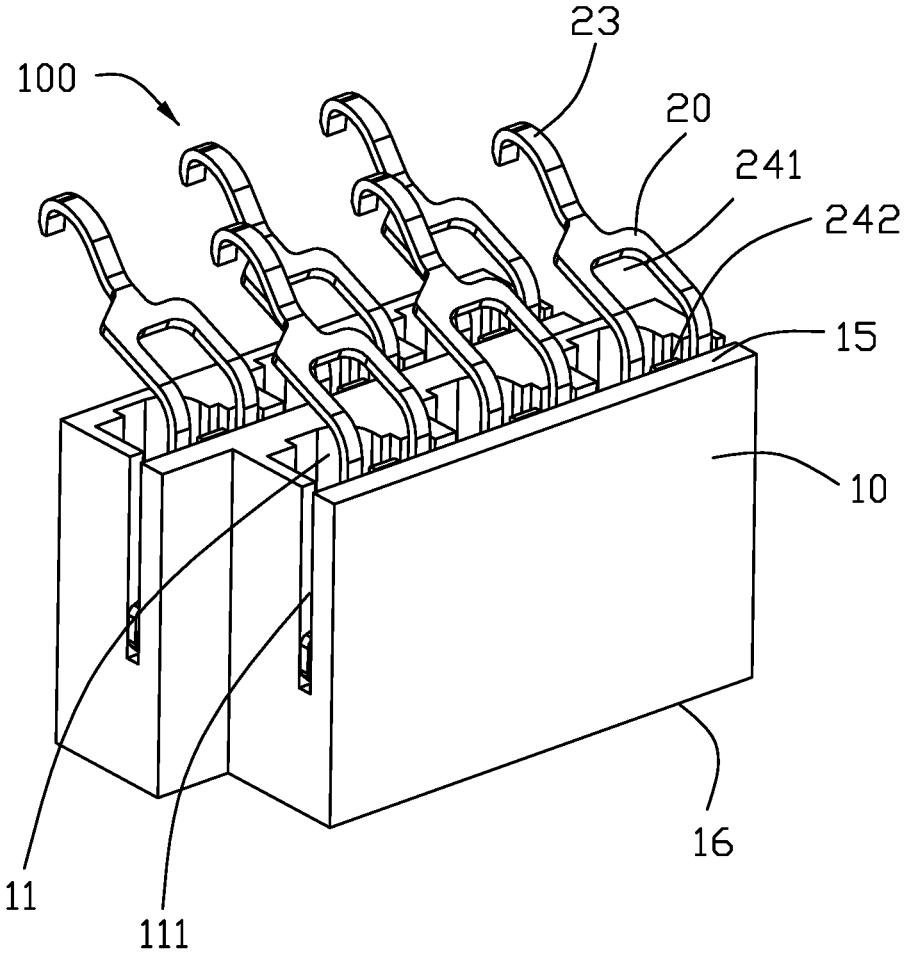
FIG. 5 is a perspective view of the electrical contact assembly of FIG. 4 in the connector at the final position.
Figure 6:
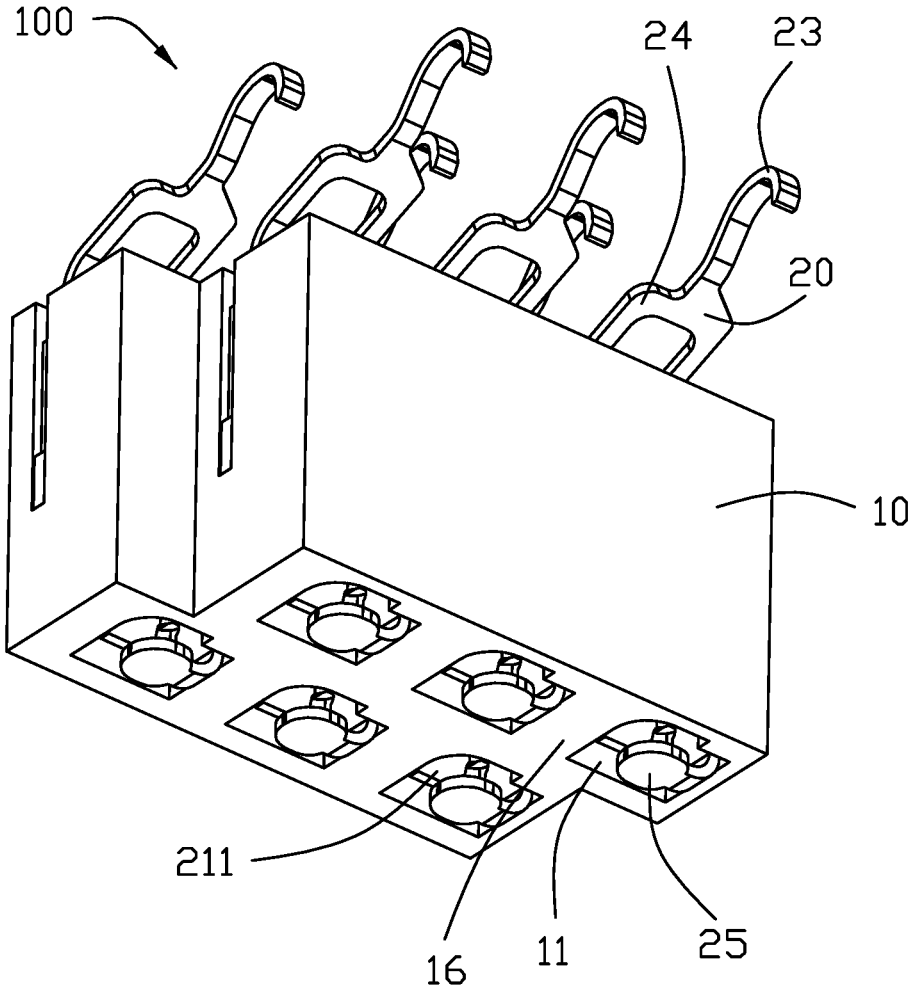
FIG. 6 is a perspective view of the electrical contact assembly of FIG. 5 in the connector.
Figure 7:
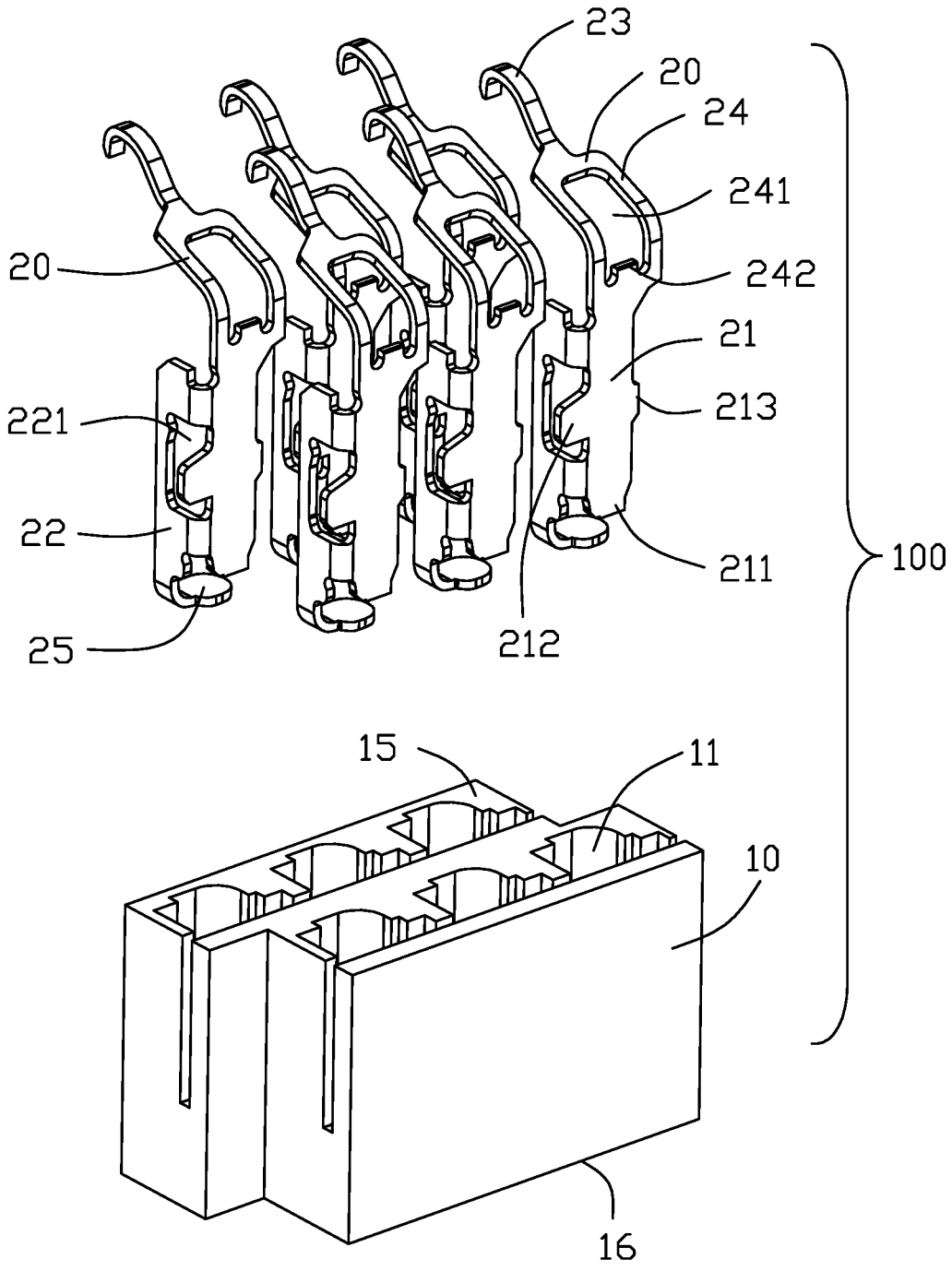
Figure 8:
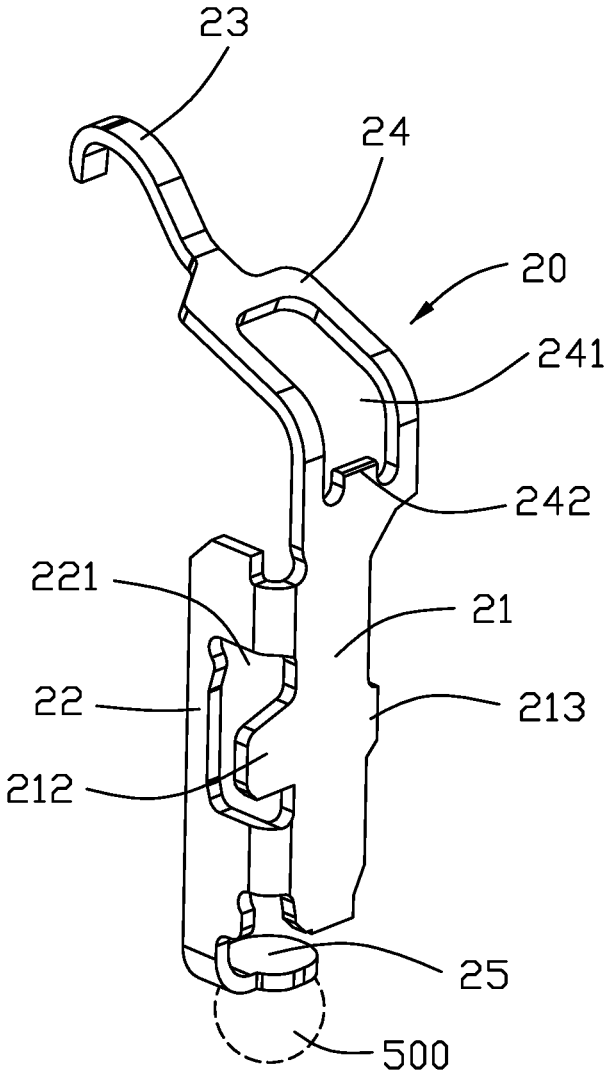
FIG. 8 is a perspective view of each contact of the electrical contact assembly of FIG. 7.
Figure 9:
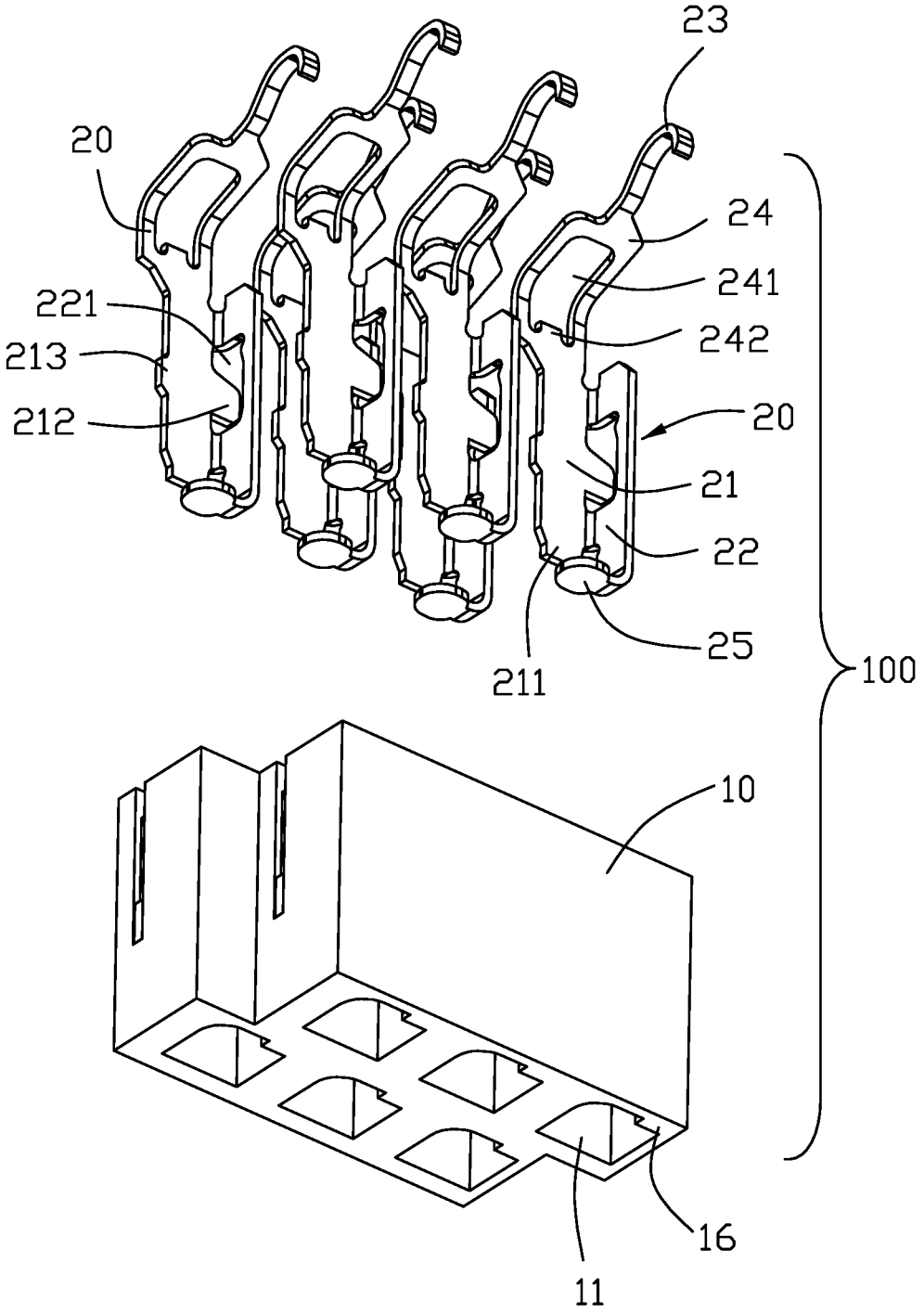
FIG. 9 is another perspective view of the electrical contact assembly separated from the corresponding housing of the connector of FIG. 7.

Referring to FIGS. 1-9, an electrical connector for mounting to a printed circuit board (PCB) 600 and receiving a CPU or electronic package 700 to achieve connection between the CPU and the PCB, includes an insulative housing 10, and a plurality of contacts retained in the housing 10. The housing 10 forms opposite upper surface 15 and lower surface 16 with a plurality of passageways 11 extending therethrough both the upper surface 15 and the lower surface 16. Each of the passageway 11 is equipped with a retention groove 111 on one side thereof. The retention groove 111 extends through the upper surface 15 while hidden behind the lower surface 16.

The contacts 20 are received within the passageways 11 and arranged in matrix corresponding to the passageways 11. Each contact 20 includes a main body 21, an auxiliary part 22 linked to one side edge of the main body 21 at an angle. A spring arm 24 extends upwardly from an upper end of the main body 21 with a curved contacting section 23 for contacting the CPU. A solder/connection pad 25 extends from a bottom end of the auxiliary part 22 for either directly soldering to the PCB or indirectly through a solder ball 500. The contacts 20 are arranged in rows and columns. Both the main body 21 and the auxiliary part 22 are located within the corresponding passageway 11 while the spring arm 24 extends upwardly above the upper surface 15.

The spring arm 24 forms a slot 241 extending along the extension direction of the spring arm 24 in alignment with a centerline thereof. The transverse dimension, i.e., the width, of the main body 21, is larger than that of the contacting section 23 while smaller than that of the spring arm 24. A retention section 212 extends from the main body 21 and retained in the retention groove 111. The auxiliary part 22 forms an opening 221 in which the retention section 212 is disposed. An another retention section 213 is formed on the other side of the main body 21 opposite to the retention section 212. The contact 20 is retained in the corresponding passageway 11 via retention provided by the retention sections 212, 213. The retention sections 212 and 213 can differently sized and positioned.

A removable holding base 202 is originally linked to a lower (connection) end 211 of the main body 21. An optionally removable holding tab 201 is originally linked to an upper (connection) end 242 of the main body 21. The holding tab 201 is located within a bottom region of the slot 241. A pair of notches 204 are formed at two opposite sides of the holding tab 204 for cooperation with the corresponding fixture (not shown) which is used to downwardly insert the contact 20 into the corresponding passageway 11. A pair of notches 203 are located by two sides of the upper ends 242 for facilitating removal of the holding tab 201.

When the contact 20 is completely assembled into the corresponding passageway 11, the upper end 242 is flush with the upper surface 15, and the lower end 211 is located above the bottom surface 16.

A process of assembling the contacts 20 into the passageways 11 is as follows:

(1) providing an insulative housing 10 with a plurality of passageways 11 therein;

(2) providing a plurality of contacts 20 each with a main body 21 and an auxiliary part 22 laterally linked with each other, a spring arm 24 extending upwardly from an upper portion of the main body 21 with a curved contacting section 23 for connecting to the CPU, a solder pad 25 extending from a bottom portion of the auxiliary part 22 for mounting to the PCB, a removable holding base 202 originally liked to a lower end 211 of the main body 21, and an optionally removable holding tab 201 originally lined to an upper end 242 of the main body 21;

(3) via provision of a first stage fixture 800 (roughly shown in FIG. 1), densely arranging the contacts side by side in one row via the corresponding holding bases 202 of each contact 20 intimately located beside the corresponding holding base 202 of the neighboring contact 20 wherein the posts of the fixture extend through the corresponding holes in the holding base 202 for efficiently holding the holding base 202 in position, thus assure the true positions of the contacts 20 in the same row;

(4) providing a second stage fixture 900 (roughly shown in FIG. 1) to grasp all the corresponding holding tabs 201 of the contacts 20 in the same row for efficiently holding the contacts 20 in the true positions;

(5) severing the holding bases 202 from the main bodies 21 of the corresponding contacts 20, respectively;

(6) applying forces upon the second stage fixture to downwardly inserting the corresponding contacts 20 into the corresponding passageways 11 until the holding tab 201 of each contact 20 reaches the ready-to-break position/level;

(7) severing the holding tabs 201 from the main bodies 21 of the corresponding contacts 20, respectively; and (8) applying a downward force upon each upwardly exposed upper end 242 to further downwardly insert the corresponding contacts 20 into the corresponding passageways 11, respectively, until the upper end 242 is flush with the upper surface 15 of the housing 10.

Understandably, the reason why there are two steps for downwardly inserting the contacts 20 into the corresponding passageways 11, is to easily remove the holding tabs 201 when the contacts 20 are located at the upper/intermediate position, compared with the lower/final position. It is also noted that in the invention because the contact 20 includes the auxiliary part 22 thus increasing the width of the contact 20 when the contact 20 is in an extended/expanded manner, it is relatively difficult to use the single contact carrier strip to have the contacts in the same row directly formed on the signal contact carrier strip. It is the reason why each contact 20 is required to be severed to be an independent/discrete piece beforehand with the associated holding base 202 and the holding tab 201 whereby all the contacts 20 in the same row may be held in their true positions by cooperation with the holding bases 202 and the first stage fixture 800 initially, and successively can be further grasped via cooperation with the holding tabs 201 and the second stage fixture 900. Once the contacts 20 are reliably held by the second stage fixture 900, the holding bases 202 can be removed/severed away from the main bodies 21 for allowing downward insertion of the contact 20 into the corresponding passageway 11. In this invention, because the holding tab 201 is equipped with the side notches 204, it is allowed to have the fixture 900 directly grasp thereon to apply the force to the contact 20 for downward inserting the contact 20 into the corresponding passageway 11 and successively severing the holding tab 201 from the main body 21. Anyhow, in some situation with the proper configuration of the spring arm, it is not necessary to remove the holding tab 201 but leaving the holding tab on the contact 20 after assembled.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining opposite top surface and bottom surface in a vertical direction;

a plurality of passageways formed in the housing and extending through both the top surface and the bottom surface;

a plurality of rows of contacts retained in the corresponding passageways, respectively, each of the contacts including:

a main body defining a lower connection end adapted to be originally linked to a removable holding base and an upper connection end adapted to be originally linked to a removable holding tab;

an auxiliary part extending from a lateral side of the main body at an angle in a top view along the vertical direction;

a connection pad extending on a bottom end of the auxiliary part for mounting to a printed circuit board; and a spring arm extending from an upper portion of the main body with a contacting section thereof for connecting to an electronic package; wherein a transverse dimension of the contact in an extended manner is larger than a pitch of the contacts in a same row.

2. The electrical connector as claimed in claim 1, wherein said spring arm defines a slot, and the corresponding holding tab is located at a bottom region of the slot.

3. The electrical connector as claimed in claim 1, wherein the main body forms a retention section received within a retention groove beside the passageway for retaining the contact to the housing, and the auxiliary part forms an opening in which the retention section is located.

4. The electrical connector as claimed in claim 1, wherein a width of the main body is larger than that of the contacting section while being smaller than that of the spring arm.

5. The electrical connector as claimed in claim 1, wherein said connection pad is adapted to be attached with a solder ball.

6. The electrical connector as claimed in claim 1, wherein the holding tabs are removed once the contacts are downwardly assembled into the corresponding passageways with each contact reaching an intermediate position in the vertical direction.

7. A method of making an electrical connector, comprising steps of:

providing an insulative housing with a plurality of passageways extending therethrough in a vertical direction;

providing a plurality of contacts in a row direction perpendicular to the vertical direction, each contact including a main body, a spring arm extending from an upper portion of the main body with a contacting section for connecting to an electronic package, a removable holding base originally linked to a lower connection end of the main body, a removable holding tab originally linked to an upper connection end of the main body, an auxiliary part sidewardly linked to the main body at an angle in a top view along a vertical direction, a connection pad formed at a bottom end of the auxiliary part;

densely arranging and firmly holding the holding bases of individual discrete contacts together along said row direction;

grasping the holding tabs of the contacts;

removing the holding bases from the corresponding main bodies;

downwardly inserting the contacts into the corresponding passageways in the vertical direction via the corresponding holding tabs until the contact reaches an intermediate position in the vertical direction.

8. The method as claimed in claim 7, further including a step of removing the holding tabs from the corresponding main bodies after each contact reaches the intermediate position.

9. The method as claimed in claimed 10, further including a step of downwardly pushing each contact from the intermediate position to a final position in the vertical direction after removing the holding tabs from the corresponding main bodies.

10. The method as claimed in claim 9, wherein the connection pad of the auxiliary part is attached with a solder ball.

11. The method as claimed in claim 7, wherein the main body forms a retention section to be received within a retention groove beside the corresponding passageway, and the auxiliary part forms an opening in which the retention section is located.

12. The method as claimed in claim 7, wherein a width of the contact in an extended manner is larger than a pitch of the contacts in the row direction, thus requiring holding the corresponding holding bases of the individual discrete contacts together in the row direction before grasping the corresponding holding tabs.

* * * * *